US006097344A

United States Patent [19]

Anderson

[11] Patent Number: 6,097,344

[45] Date of Patent: Aug. 1, 2000

[54] MAST MOUNTING DEVICE FOR RADAR

[76] Inventor: Kenneth L. Anderson, 1200 Smith Ct., Rocky River, Ohio 44116

[21] Appl. No.: 09/081,053

[22] Filed: May 19, 1998

Related U.S. Application Data

[60] Provisional application No. 60/047,037, May 19, 1997.

[51] Int. Cl.[7] ..... H01Q 1/34

[52] U.S. Cl. ..... 343/709; 343/882; 343/878; 248/218.4; 114/343

[58] Field of Search ..... 343/709, 711, 343/878, 880, 882, 891, 892; 248/218.4, 247; 114/90, 343; H01Q 1/34

[56] References Cited

U.S. PATENT DOCUMENTS

| | | | |
|---|---|---|---|
| 4,659,044 | 4/1987 | Armstrong | 248/218.4 |
| 4,694,773 | 9/1987 | Sparkes et al. | 114/354 |
| 5,111,212 | 5/1992 | DeSatnick et al. . | |
| 5,154,386 | 10/1992 | Heck | 248/230 |
| 5,417,178 | 5/1995 | Harrelson | 114/343 |
| 5,489,911 | 2/1996 | Gordon et al. | 343/709 |
| 5,755,416 | 5/1998 | Leek | 248/247 |

*Primary Examiner*—Don Wong
*Assistant Examiner*—Shih-Chao Chen
*Attorney, Agent, or Firm*—Fay, Sharpe, Fagan, Minnich & McKee, LLP

[57] ABSTRACT

A device (10) for mounting a radar antenna to a support structure such as a mast (M) includes a generally U-shaped frame (12). A proximal end (14) of the frame is adapted for securement to the support structure while the frame extends generally horizontally outward from the support structure and terminates at a closed distal end (16). A radar antenna mounting platform assembly (20) has a longitudinal axis (L) and is pivotally connected between the support structure and the distal end of the frame at a position within the U-shaped frame. The device includes means (60) for selectively pivoting the radar platform bi-directionally about its longitudinal axis. The platform is preferably pivotable at least 20° in either direction from horizontal to define an overall arc of at least 40°. The pivoting means is remotely operable, e.g., from the deck or cockpit of the boat, and maintains the antenna mounting platform at a select angular orientation and prevents angular movement of the platform in response to movement of the support structure.

20 Claims, 4 Drawing Sheets

MAST MOUNTING DEVICE FOR RADAR

This application claims the benefit of U.S. Provisional Application Ser. No. 60/047,037, entitled "Mast Mounting Device for Radar," filed May 19, 1997.

The present invention relates generally to a mounting device for a radar antenna, and finds particular application in conjunction with sailboats which are subject to heeling during normal use. The invention acts to provide a secure mounting for the radar antenna to a sailboat mast while allowing selective pivoting of the antenna during heeling conditions such that the antenna is maintained substantially horizontal.

Mounting devices for radar antennae have been provided previously for use on or with sailing vessels. Some mounting devices fix the position of the radar antenna and do not facilitate any pivotal movement to compensate for heeling. More commonly, the prior radar mounts have included some type of self-leveling mechanism which allows the mounted radar antenna to swing freely and, thus, naturally assume a horizontal position. Some self-leveling mounts have further included dampening means to prevent the uncontrolled swinging and constant searching for horizontal generally associated with undampened types of the devices.

These prior radar mounting devices have not proven to be entirely satisfactory. Fixed radar mounts allow the radar to be used in only the calmest conditions or when the sailing vessel has assumed a course, relative to the wind direction, that does not induce more than minimal heeling of the sailboat. Undesirable deficiencies are also associated with self-leveling radar mounting devices. The undampened devices allow the uncontrolled swinging of the radar antenna which destroys accuracy and can also damage the antenna or its connections and associated cables over time. The dampened devices are somewhat preferred relative to the undampened devices, but the dampened devices can be expensive, subject to malfunction, and/or require an undue amount of maintenance. With both dampened and undampened self-leveling radar mounts, the constant back-and-forth pivoting of the radar antenna has been found to cause excessive wear in the electrical cables and associated fittings that connect the radar antenna to the radar system of the boat. Moreover, in the extreme environment of a sailing vessel, any deterioration of the electric cables and fittings tends to allow penetration of moisture which can render the system inoperable or even cause permanent damage to sensitive electronic components.

Furthermore, prior radar mounting devices are often unsuitable for connection directly to a sailboat mast. Instead, their complex nature and shape require mounting away from the sails to prevent the potential for sail damage. Thus, some self-leveling devices have previously been mounted toward the stern of the boat on a separate post or mast dedicated for the radar antenna mount.

In general, even when "tacking" upwind, a radar antenna on a sailing vessel does not require constant leveling. Although wind gusts and waves will briefly alter the angle of heeling, it is not necessary for the radar antenna mounting device to compensate continuously for such variations in heeling angle.

Accordingly, it is deemed desirable to develop a new and improved mast mounting device for radar which would overcome the foregoing deficiencies and others while providing better and more advantageous overall results.

SUMMARY OF THE INVENTION

The present invention is, therefore, directed to a mast mounting device for radar that overcomes the foregoing deficiencies and others associated with prior radar mounting devices.

In accordance with the present invention, the radar mounting device is particularly adapted to use with a sailboat and includes a frame for connection or mounting to a mast. More particularly, a proximal end of the frame is secured to the sailboat mast. The frame extends generally horizontally outward from the mast and terminates at a distal end. The frame is preferably U-shaped, with the closed portion thereof defining the distal end. A radar mounting platform assembly has a longitudinal axis and is pivotally connected between the mast and the distal end of the frame at a position within the U-shaped frame. The device includes means for selectively pivoting the radar platform bi-directionally about its longitudinal axis. The platform may preferably be pivoted at least 20° in either direction from horizontal to define an overall arc of at least 40°. The pivoting means is remotely operable from the deck or cockpit of the sailboat.

In accordance with more limited aspects of the present invention, the frame includes an angled support leg extending between the distal end of the frame and the mast. This support leg braces the frame and provides a convenient anchor point for the pivoting means. The pivoting means is preferably provided by a fluid cylinder, an electric motor, or any other suitable actuator. Alternatively, the pivoting means can be provided by a manual system including at least one rope, cable, or lever connected to the radar mounting platform and operable from the deck or cockpit of the sailboat to selectively pivot the platform and an associated radar antenna.

One advantage of the present invention resides in the provision of an improved mast mounting device for a radar antenna.

Another advantage is found in a new system that securely connects a radar antenna to a sailboat mast without presenting an obstruction to normal sail movement.

Still another advantage of the invention is the provision of a radar mounting system that allows the position of the radar antenna to be selectively adjusted without constant movement thereof in response to small deviations in heel angle.

Yet another advantage of the present invention is found in minimizing flexing and other movement of the electrical cables and fittings associated with the radar antenna to lengthen the useful life of such components.

Still other benefits and advantages of the invention will become readily apparent to those skilled in the art upon reading and understanding the following detailed specification.

BRIEF DESCRIPTION OF THE DRAWINGS

The invention may take form in certain components and structures, preferred embodiments of which are illustrated in the accompanying drawings which form a part hereof and wherein.

DETAILED DESCRIPTION OF THE PREFERRED EMBODIMENT

Figure 1:
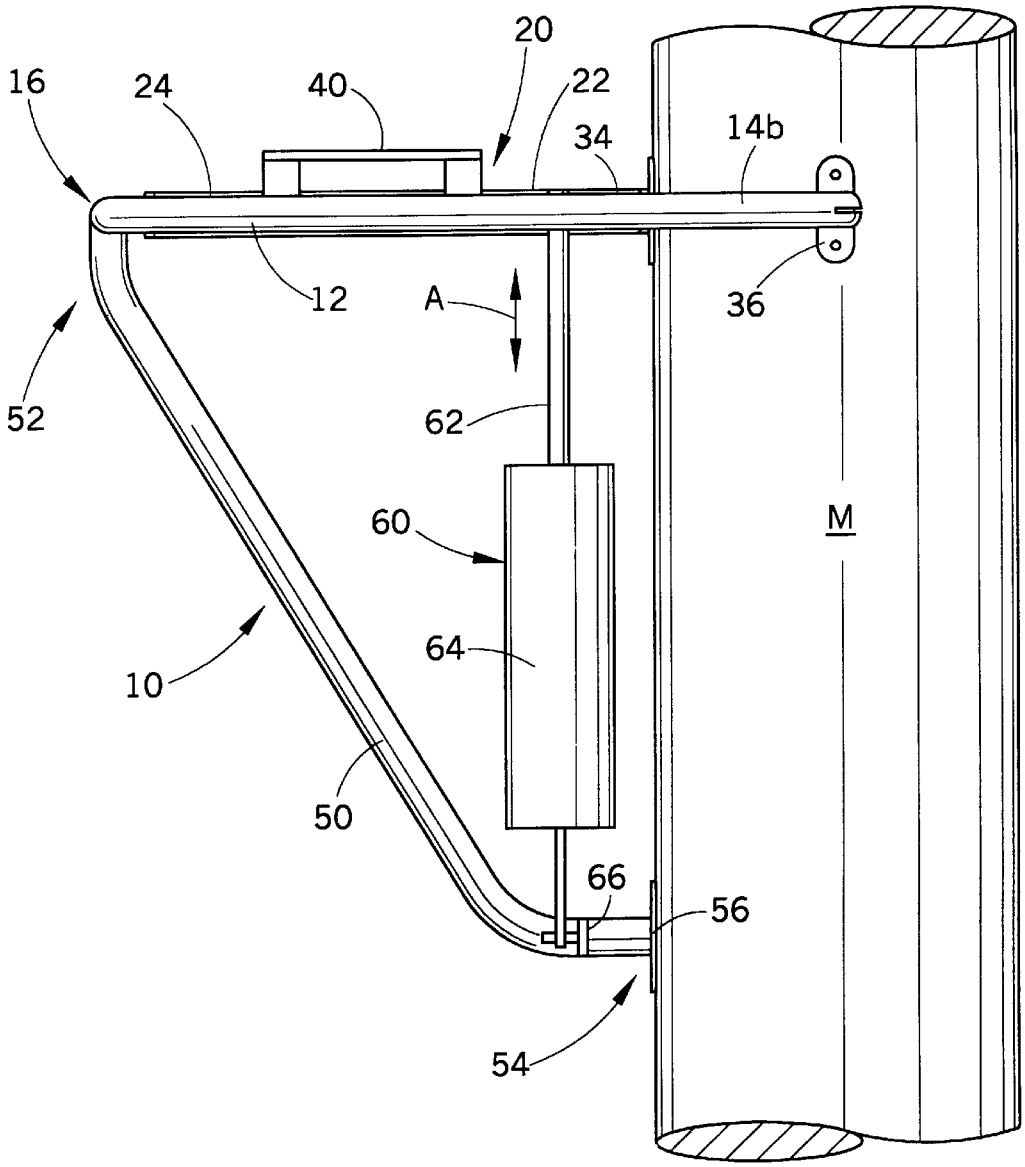
FIG. 1 is a side elevational view of a mast mounting device for a radar antenna formed in accordance with the present invention.
Figure 2:
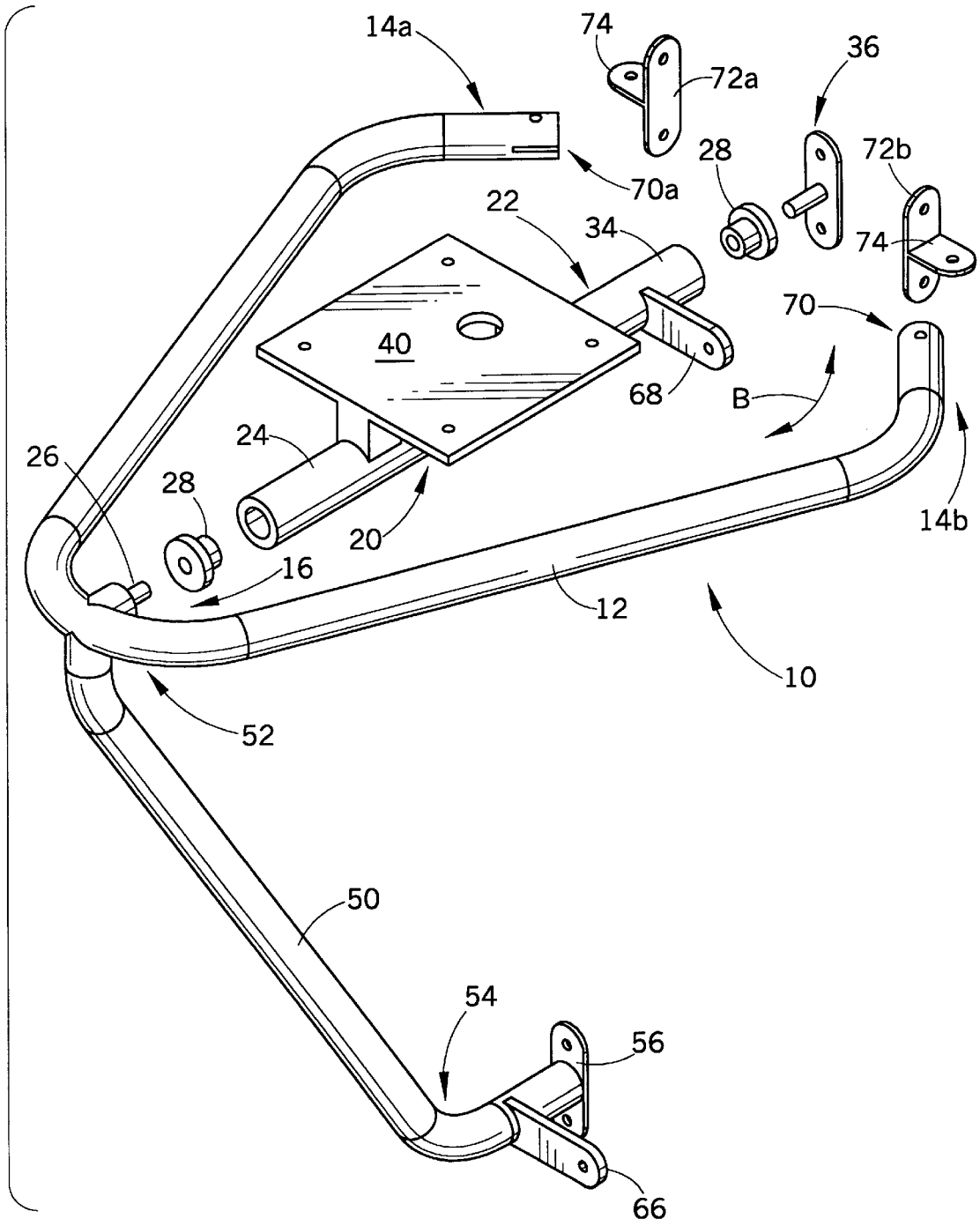
FIG. 2 is an exploded perspective view of the radar antenna mounting device shown in FIG. 1.

Referring now to the drawings which are for purposes of showing preferred embodiments of the invention only and not for purposes of limiting the same, FIGS. 1 and 2 show a sailboat mast mounting device or apparatus for a radar antenna generally designated 10. Except as otherwise provided, the components of the apparatus 10 are fabricated from stainless steel or another corrosion resistant metal. The apparatus 10 includes a frame 12 which connects to a sailboat mast M. More particularly, the frame 12 is preferably generally U-shaped and includes proximal ends 14*a*, 14*b* fixedly secured to the mast M. The frame 12 extends generally horizontally outward from the mast and terminates at a closed, U-shaped distal end 16.

Figure 7:
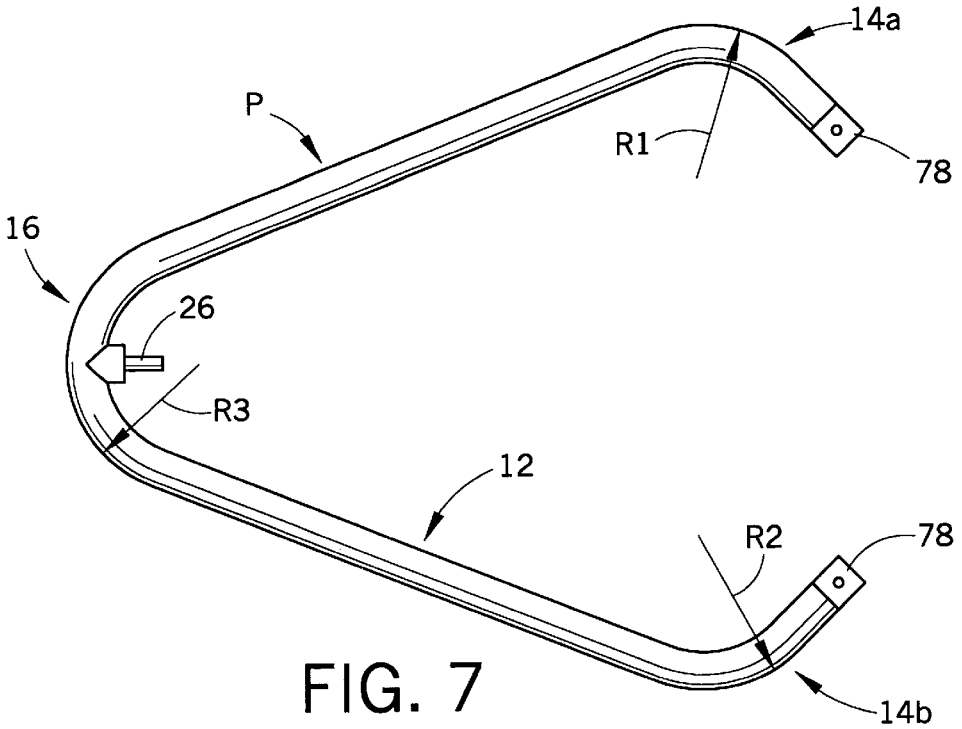
FIG. 7 is a top plan view of the frame formed in accordance with the invention.

With reference now also to FIG. 7, it can be seen that the proximal ends 14*a*,14*b* and the distal end 16 of the frame 12 are all preferably curved to have spherical radii R1,R2,R3, respectively. For example, each radius R1–R3 can be at least approximately 3" to define the frame 12 as having a gradually curved perimeter P. Because frame 12 is connected to sailboat mast M, preferably with the distal end 16 oriented toward the bow of the boat, the rounded ends 14*a*,14*b*,16 of the frame 12 minimize the potential for damage to a sail such as a jib or a spinnaker.

Figure 3A:
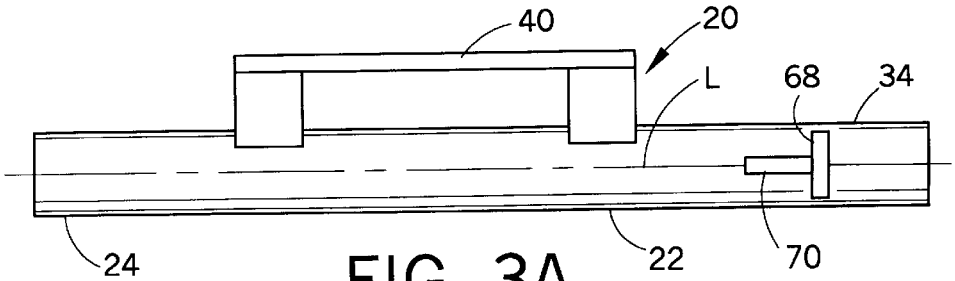
FIGS. 3A and 3B are side and front elevational views, respectively, of a radar mounting platform assembly formed in accordance with the invention.
Figure 3B:
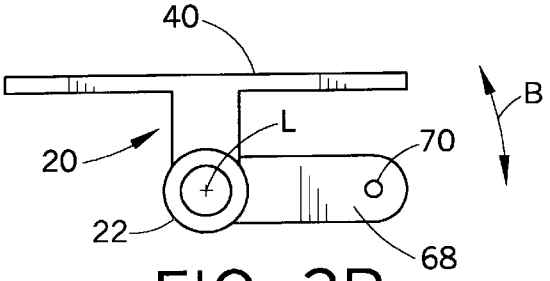
Figure 4:
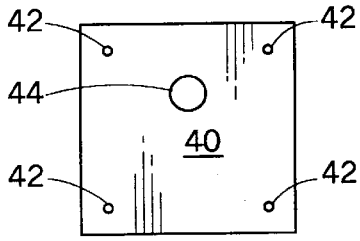
FIG. 4 is a top plan view of the platform portion of the radar mounting platform assembly of FIGS. 3A and 3B.
Figure 5:
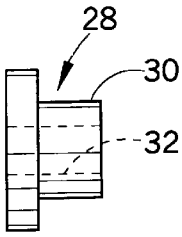
FIG. 5 is a side elevational view of a bushing interposed between the pivotable radar mounting platform assembly of FIGS. 3A and 3B and a stationary stud.
Figure 8:
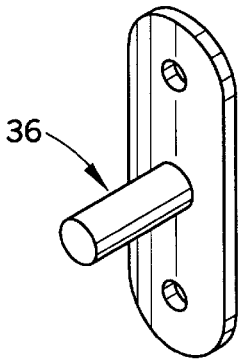
FIGS. 8, 9, and 10 show connectors used for securing the radar mounting device of FIG. 1 to a sailboat mast.

Referring now more particularly to FIGS. 2–4, a radar mounting platform assembly 20 is mounted between distal end 16 of frame 12 and mast M. This radar platform assembly is located within the U-shaped frame 12 to thereby prevent the sails from snagging on assembly 20. The radar mounting platform assembly includes a shaft 22 having a longitudinal axis L, and the platform assembly is pivotable relative to frame 12 about axis L. Specifically, a first end 24 of the shaft 22 is pivotally connected to a stud 26 located at the distal end of frame 12. Preferably, the end 24 of the shaft 22 is hollow to slidably receive the stud 26 therein. A bushing 28 is also provided to reduce friction and ensure a proper connection between shaft end 24 and stud 26. As is best seen in FIG. 5, bushing 28, preferably made of Nylon, Delrin, or the like, includes a first end 30 which is slidably received in shaft end 24. Bushing 28 includes a central through-bore 32 which receives the stud 26. A second end 34 of the shaft 22 is likewise pivotally connected to the mast M. A stud 36 (FIG. 8) is affixed to the mast M and projects outwardly therefrom. Stud 36 is slidably received within the hollow second end 34 of shaft 22. Bushing 28 is interposed between shaft 36 and the end 34 as described above in relation to shaft end 24.

The radar platform assembly 20 also includes a platform 40 mounted to shaft 22. Platform 40 provides a mounting surface for a radar antenna assembly (not shown). As is seen most clearly in FIG. 4, platform 40 includes one or more antenna mounting holes or openings 42 that receive conventional fasteners for securely connecting the radar antenna assembly to the platform. The platform also includes a through-hole 44 to receive the electrical cables for the mounted radar antenna.

Figure 6B:
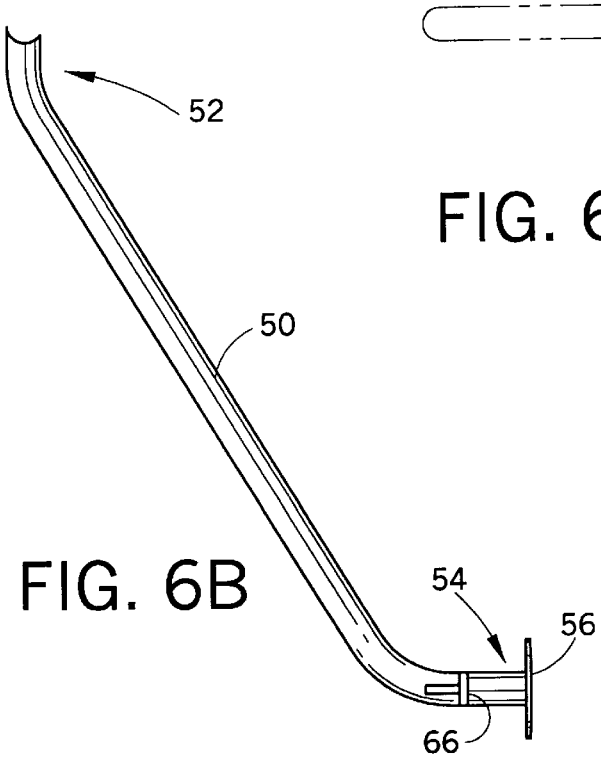
FIGS. 6A and 6B are front and side elevational views, respectively, of a support leg provided in accordance with the present invention.
Figure 6A:
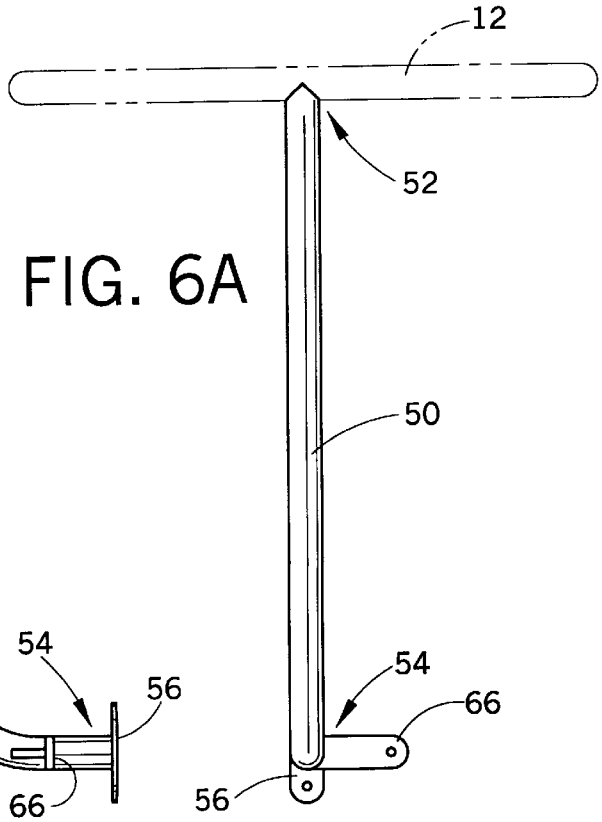
Figure 10:
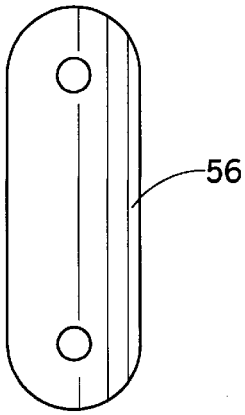

With reference now to FIGS. 1, 6A, and 6B, a support leg 50 is advantageously provided to brace the frame 12. A first end 52 of this support leg is welded or otherwise affixed to distal end 16 of frame 12. The connection between leg end 52 and end 16 of frame 12 must not include any jagged edges, protruding fasteners, or the like that could tear a sail. The lower end 54 of leg 50 is welded or secured to a plate 56 (FIG. 10) which is, in turn, connected to the mast M with convenient or suitable fasteners.

A means for selectively pivoting platform assembly 20 about longitudinal axis L is desirably provided in accordance with the invention. In the preferred embodiment shown and described, the pivoting means is remotely operable from the cockpit or deck of the sailboat. As shown in FIG. 1, the pivoting means is provided by an actuator assembly 60. This actuator assembly is comprised of an electric motor, a fluid cylinder, or the like operatively interposed between a fixed point and the pivoting platform assembly itself. Actuator 60 includes a drive or piston rod 62 which selectively retracts into and extends from a cylinder 64 under the force of a fluid such as air or hydraulic oil as is already known. In the arrangement shown, base 64 is connected to a first tongue 66 extending from support leg 50 using a suitable fastener. A second tongue 68 (FIG. 2) extends from shaft 22 of the platform assembly 20, and piston rod 62 of actuator 60 is connected thereto by means of a pin 70 or other suitable fastener. Extension and retraction of piston rod 62 thus acts to pivot platform assembly 20 about axis L as indicated by arrow B. Suitable conventional controls for selectively operating the actuator are conveniently located on deck or in the cockpit and are operably connected to the actuator by known means. Since these controls do not form a specific part of the invention, they are neither shown nor described in detail herein.

Preferably, the platform assembly is pivotable at least 20° in either direction from the normal or zero position to thus define a total arc of at least 40°. Such arc is entirely sufficient to compensate for sailboat heeling under ordinary sailing conditions.

As an alternative to the illustrated actuator, platform assembly 20 can be selectively pivoted using a manual actuator such as one or more levers, ropes, cables or the equivalent. Regardless of the particular pivoting means employed, once the angle of the platform assembly 20 is adjusted relative to horizontal, it remains fixed in that position until the pivoting means is again energized to either extend or retract.

Figure 9:
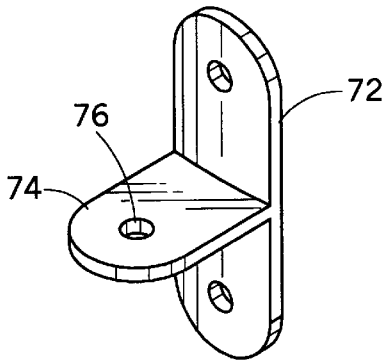

With reference now to FIGS. 2 and 9, the preferred means for connecting the proximal ends 14*a*,14*b* of the frame 12 to the mast M is shown in further detail. Each end 14*a*,14*b* includes a yoke or clevis 70*a*,70*b*, respectively. A foot 72*a*,72*b* is provided in association with each end 14*a*,14*b*, respectively. Each foot includes a tongue 74 projecting therefrom for insertion into the associated clevis 70*a*,70*b*. Moreover, each tongue 74 includes a through-hole 76 (FIG. 9) and each clevis 70*a*,70*b* also includes a through-hole 78 (FIG. 7). These through-holes accommodate a pin or other suitable fastener for connecting the tongue 74 of each foot to its associated clevis when the holes 76,78 are aligned.

It can be appreciated from the foregoing that the radar antenna mounting device 10 of the present invention provides for selective pivoting of a radar antenna mounted on platform 40 to advantageously compensate for sailboat heeling. However, the antenna is not allowed to pivot freely. Rather, an actuator 60 or other drive or force means controllable from the deck or cockpit provides for selective pivoting of the radar mounting platform assembly about axis L. The platform assembly 20 is maintained in a selected position until the pivoting means is energized when and as needed to properly position the radar antenna in response to the degree of sailboat heeling. Frame 12 of the mounting device surrounds platform assembly 20 and prevents inadvertent snagging of a sail on the platform assembly. Thus, the new radar mounting device can be installed on a mast of a sailing vessel without fear of tearing or damaging a sail.

The invention has been described with reference to a preferred embodiments. Obviously, modifications and alterations will occur to others upon reading and understanding the preceding specification. It is intended that the invention be construed as including all such modifications and alterations insofar as they come within the scope of the appended claims or the equivalents thereof.

Having thus described the preferred embodiments, the invention is now claimed to be:

1. A radar antenna mounting device for operatively securing a radar antenna to a support structure, said mounting device comprising:

a frame defining a periphery, said frame including a closed distal end and first and second proximal end portions adapted for being fixedly secured to said support structure so that said closed distal end extends outwardly from said support structure;

an antenna platform assembly pivotably secured to said frame and situated generally within said periphery of said frame; and, means adapted for selectively pivoting said antenna platform assembly relative to said frame and for adjusting and fixedly maintaining an angular position of said platform assembly relative to said frame, said pivoting means adapted for preventing pivoting of said platform assembly relative to said frame incident to movement of said support structure.

2. The radar antenna mounting device as set forth in claim 1, wherein said antenna platform assembly includes a shaft with a longitudinal axis and an antenna mounting member secured to said shaft, wherein said shaft is pivotally connected to said closed distal end of said frame and is adapted for pivotal securement to said support structure.

3. The radar antenna mounting device as set forth in claim 1, further comprising an angled support leg extending between said distal end of said frame and said support structure to brace the frame.

4. The radar antenna mounting device as set forth in claim 1, wherein said distal end of said frame is defined at least partially by a radius of curvature of at least approximately three inches so as to define said frame distal end in a generally U-shaped conformation.

5. The radar antenna mounting device as set forth in claim 3, wherein said pivoting means comprises an actuator interposed between said angled support leg and said antenna platform assembly.

6. The radar antenna mounting device as set forth in claim 5, wherein the antenna platform assembly shaft and the angled support leg each include a tongue extending outwardly therefrom, said actuator connected at a first end to said tongue of said angled support leg and connected at a second end to said tongue of said shaft.

7. The radar antenna mounting device as set forth in claim 5, wherein said actuator is operable from a remote location and comprises at least one of a fluid cylinder, an electric motor, and a manually operable mechanical actuator assembly.

8. The radar antenna mounting device as set forth in claim 2, wherein said pivoting means is adapted to pivot said platform assembly about said longitudinal axis of said shaft at least twenty degrees in both first and second opposite angular directions from a zero position where said antenna mounting member is substantially horizontal to define a total angular arc of at least forty degrees.

9. The radar antenna mounting device as set forth in claim 2, wherein said antenna mounting member includes at least one aperture therein for passage of at least one radar antenna electrical cable therethrough.

10. The radar antenna mounting device as set forth in claim 2, further comprising:

a first mounting stud projecting outwardly from the periphery of said frame at said closed distal end of said frame;

a second mounting stud adapted for securement to said support structure to extend outwardly therefrom toward the distal end of said frame, wherein first and second opposite ends of said shaft are adapted for pivotal connection to said first and second mounting studs, respectively.

11. The radar antenna mounting device as set forth in claim 10, wherein said first and second studs are received respectively into hollow first and second opposite ends of said shaft, said radar antenna mounting device further comprising first and second bushings received respectively in said hollow first and second shaft ends and interposed radially between said shaft and said studs to facilitate pivotal movement of said shaft relative to said mounting studs.

12. The radar antenna mounting device as set forth in claim 2, wherein said first and second proximal end portions of said frame each comprise a clevis for attachment respectively to first and second tongues projecting outwardly from said support structure.

13. An apparatus for operatively securing a radar antenna to a boat mast, said apparatus comprising:

a frame member adapted for connecting to a mast and extending outwardly therefrom, said frame member defining a curved periphery;

an elongated shaft having a first end pivotally secured to said frame and a second end adapted for pivotal securement to the mast, said shaft being pivotable about a longitudinal axis;

an antenna mounting platform secured to said shaft; and, an actuator adapted for selectively varying the angular orientation of the mounting platform relative to the frame to compensate for boat heeling by rotating the shaft about its longitudinal axis, said actuator selectively immovably securing the shaft and associated mounting platform against rotational movement in response to movement of said mast.

14. The apparatus as set forth in claim 13, wherein said actuator comprises at least one of a fluid cylinder, an electric actuator, and a manual actuator.

15. The apparatus as set forth in claim 14, wherein said frame is generally U-shaped with an open proximal end adapted for securement to a mast and a closed distal end spaced from said mast.

16. The apparatus as set forth in claim 15, wherein said frame is fabricated from tubular stainless steel and wherein said distal end is defined at least partially by a radius of curvature of at least approximately three inches.

17. The apparatus as set forth in claim 13, wherein said shaft is rotatable relative to said frame at least approximately twenty degrees in first and second opposite angular directions from a home position where the mounting platform is generally horizontal.

18. The apparatus as set forth in claim 15, wherein said shaft is adapted for pivotal securement between the closed U-shaped distal end of the frame and the mast.

19. The apparatus as set forth in claim 18, wherein said shaft is pivotally connected to said frame and said mast by first and second studs projecting respectively from the frame and the mast, wherein said studs are respectively received in first and second hollow ends of said shaft.

20. The apparatus as set forth in claim 19, further comprising first and second bushings interposed between said first and second studs and said first and second shaft ends to facilitate pivotal movement of said shaft about said studs.

* * * * *